US006942632B2

(12) United States Patent
Cho

(10) Patent No.: US 6,942,632 B2
(45) Date of Patent: Sep. 13, 2005

(54) WRIST SUPPORT APPARATUS FOR BOWLING

(76) Inventor: Young-Kook Cho, 15/2, 829-38 Mangmee-dong, Sooyoung-gu, Busan (KR) 613-130

( * ) Notice: Subject to any disclaimer, the term of this patent is extended or adjusted under 35 U.S.C. 154(b) by 0 days.

(21) Appl. No.: 10/507,934

(22) PCT Filed: Mar. 25, 2003

(86) PCT No.: PCT/KR03/00586

§ 371 (c)(1),
(2), (4) Date: Oct. 18, 2004

(87) PCT Pub. No.: WO03/080198

PCT Pub. Date: Oct. 2, 2003

(65) Prior Publication Data

US 2005/0131330 A1 Jun. 16, 2005

(30) Foreign Application Priority Data

Mar. 26, 2002 (KR) ..... 10-2002-0016390

(51) Int. Cl.[7] ..... A61F 13/00
(52) U.S. Cl. ..... 602/64; 602/21; 128/878; 473/62
(58) Field of Search ..... 602/64, 20, 21, 602/22, 16, 5, 60, 61, 62; 128/869, 878, 879, 128/880, DIG. 15; 2/16, 20, 170; 473/59, 473/62

(56) References Cited

U.S. PATENT DOCUMENTS 3,117,786 A * 1/1964 Anderson ..... 473/59
3,269,728 A * 8/1966 Blough ..... 473/62
3,512,776 A * 5/1970 Thomas, Sr. ..... 473/62
3,815,908 A * 6/1974 Hashimoto ..... 473/62
4,479,648 A * 10/1984 Alivo, Jr. ..... 473/62
4,666,158 A 5/1987 Moro
5,427,577 A * 6/1995 Picchietti et al. ..... 473/59
5,466,192 A 11/1995 Castolo et al.
5,708,981 A * 1/1998 Tilton ..... 2/170
6,694,523 B2 * 2/2004 Hurst ..... 602/21
6,790,192 B2 * 9/2004 Robinson ..... 602/21
6,835,182 B2 * 12/2004 Darcey ..... 602/20

FOREIGN PATENT DOCUMENTS

| | | |
|---|---|---|
| JP | 10-174733 | 6/1998 |
| KR | 20-0165480 | 2/2000 |
| KR | 10-0254116 | 4/2000 |

* cited by examiner

*Primary Examiner*—Fadi H. Dahbour
(74) *Attorney, Agent, or Firm*—Jordan and Hamburg LLP

(57) ABSTRACT

The present invention relates to a wrist apparatus for handling a bowling ball. The apparatus comprises a hand plate to which is affixed a strap controller which clamps the back of wrist to the hand plate efficiently by tightening the strap with fixed and rotating rollers placed on each side of the hand plate, respectively; a rotating angular mechanism which includes a projection placed on both top and bottom of the hand plate to allow the user to pre-select accurate angles of disposition between the hand plate and the wrist plate; an angular control gauge with a sill to make the angular control easy for moving upward and downward; and a fixed roller of wrist strap placed on both sides of the wrist plate where the hand plate is connected to; thus, enabling the user to adjust the wrist support to a comfortable position for both hands.

4 Claims, 11 Drawing Sheets

WRIST SUPPORT APPARATUS FOR BOWLING

FIELD OF THE INVENTION

The present invention relates to a wrist supporting apparatus for a bowling, and more particularly to a wrist supporting apparatus comprising a hand-strap slot for accommodating one end of a hand-strap that securely fixes a hand pad to the back of a hand, the hand-strap slot being provided with jagged protrusions so as to adjust and secure the hand-strap in desired position; a fixed roller facilitating an attraction of the hand-strap when fastening the hand-strap; a moveable roller that further firmly attracts the hand strap being tensed by the fixed roller whereby the hand-strap can be fasten with optimized tension; a horizontal angle adjusting means having a plurality of protrusions such as a gear so that the hand pad can be freely adjusted and securely fixed in a preferred angle in association with a wrist pad; a vertical angle adjusting means for adjusting vertical angle of the hand pad in association with a wrist pad, which is provided with a flange so as to restrict the movement thereof; and a wrist pad having a symmetric shape in direction of a left side and a right side whereby the wrist pad can be installed to any hand pads regardless of its direction.

BACKGROUND OF THE INVENTION

Conventionally, most bowlers wear a wrist supporting apparatus for imparting to a ball an appropriate roll and a spin in order to make curved path line that is efficient in striking pins. Recently, such wrist supporting apparatus have been developed in various designs and functions. For example, the Korean Patent registration No. 100254116000, which was invented by the applicant of the present invention, has disclosed a wrist supporting apparatus comprising a hand pad having a plurality of recessions thereon; a center panel of a circular shape that engages with said recessions of said hand pad by means of a ball elastically supported by a spring; and a wing nut that secures said hand pad, said center panel and a vertical angle adjusting means through a aperture formed thereon. For another example; the Korean Utility Model registration No. 2001654800000 has disclosed a wrist supporting apparatus, which is provided with a vertical angle adjusting means comprising a threaded shaft rotatably installed through a case in a longitudinal direction of a wrist pad; a slider having a threaded hole therein engaging with said threaded shaft so that the slider linearly moves in response to the rotation of said threaded shaft; a plate having fixing holes, which is securely attached to said slider; and a locking plate pivotally fixed to a hand pad by a hinge.

As described above, most wrist supporting apparatus for bowling are provided with a connecting means and an angle adjusting means. However, the connecting means and the angle adjusting means should be slightly readjusted even after wearing them.

SUMMARY OF THE INVENTION

Accordingly, an objection of the present invention is to provide a wrist supporting apparatus comprising a hand-strap slot for accommodating one end of a hand-strap that securely fixes a hand pad to the back of a hand, the hand-strap slot being formed adjacent to the one end of the hand pad and provided with jagged protrusions so as to adjust and secure the hand-strap in desired position; a fixed roller facilitating an attraction of the hand-strap fastened to said hand-strap slot by reducing a friction when fastening the hand-strap; a moveable roller that further firmly attracts the hand strap being tensed by the fixed roller, whereby the hand-strap can be fasten with optimized tension by means of a Velcro tape; a horizontal angle adjusting means including an upper part equipped with saw-toothed protrusions and an lower part also equipped with saw-toothed protrusions that engages with those of said upper part so that the hand pad can be precisely adjusted and securely fixed in a preferred angle in association with a wrist pad; a vertical angle adjusting means for adjusting vertical angle of the hand pad in association with a wrist pad, on which a flange is formed at circumference thereof so as to prevent slipping out of a supporting tip disposed at one end of a wrist pad; and a wrist pad having a symmetric shape by locating same fixed rollers to the left end and right end of thereof, respectively, whereby the wrist pad can be installed to any hand pads regardless of its direction. Depending on the necessity, a wrist-strap can be fixed to either side of fixed rollers.

Another objection of the present invention is to provide a wrist supporting apparatus comprising a hand-strap slot for accommodating one end of a hand-strap, the hand-strap slot being formed adjacent to the one end of the hand pad and provided with jagged protrusions so as to secure the hand-strap.

Another objection of the present invention is to provide a wrist supporting apparatus comprising a symmetric shape of a wrist pad connected with a hand pad, so that it is advantageous in that troublesomeness to consider a direction of the wrist pad can be eliminated.

In another embodiment of the present invention, a wrist supporting apparatus is provided with a wrist-strap slot having jagged protrusions so as to adjust and secure the hand-strap in desired position.

BRIEF DESCRIPTION OF THE DRAWINGS

The aforementioned aspects and other features of the present invention will be explained in the following description, taken in conjunction with the accompanying drawings, wherein.

DETAILED DESCRIPTION OF PREFERRED EMBODIMENTS

In order to accomplish the above-described objects, an embodiment of the present invention comprises a hand-strap slot for accommodating one end of a hand-strap that securely fixes a hand pad to the back of a hand, the hand-strap slot being provided with jagged protrusions so as to adjust and secure the hand-strap in desired position; a fixed roller facilitating an attraction of the hand-strap when fastening the hand-strap; a moveable roller that further firmly attracts the hand strap being tensed by the fixed roller, whereby the hand-strap can be fasten with optimized tension; a horizontal angle adjusting means having a plurality of protrusions such as a gear so that the hand pad can be freely adjusted and securely fixed in a preferred angle in association with a wrist pad; a vertical angle adjusting means for adjusting vertical angle of the hand pad in association with a wrist pad, which is provided with a flange at circumference thereof; and a wrist pad having a symmetric shape, whereby the wrist pad can be installed to any hand pads regardless of its direction.

Hereinafter, a preferred embodiment of the present invention is described in detail with reference to the accompanying drawings.

Referring to FIGS. 1, 2, 3 and 4, a wrist supporting apparatus 100 comprises a hand pad 101 and a wrist pad 200 which are composed of metal or non-metal having a sufficient structural rigidity. Inner surfaces of those pads are covered with resilient material 300 such as urethane in order to provide a comfort to a user.

Figure 4:
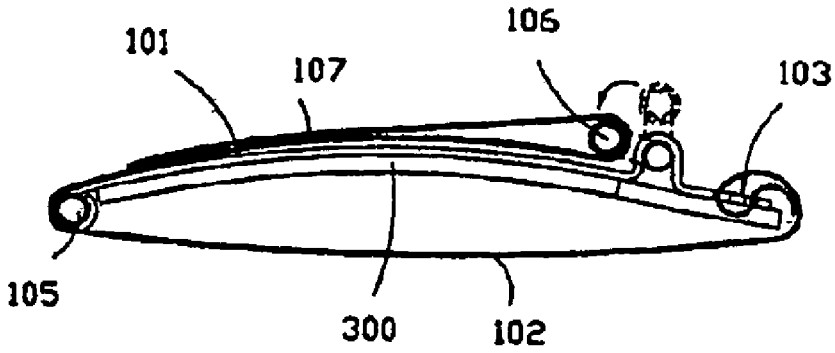
FIG. 4 is a sectional view showing a state of a hand-strap fastened by rollers according to the present invention.
Figure 5:
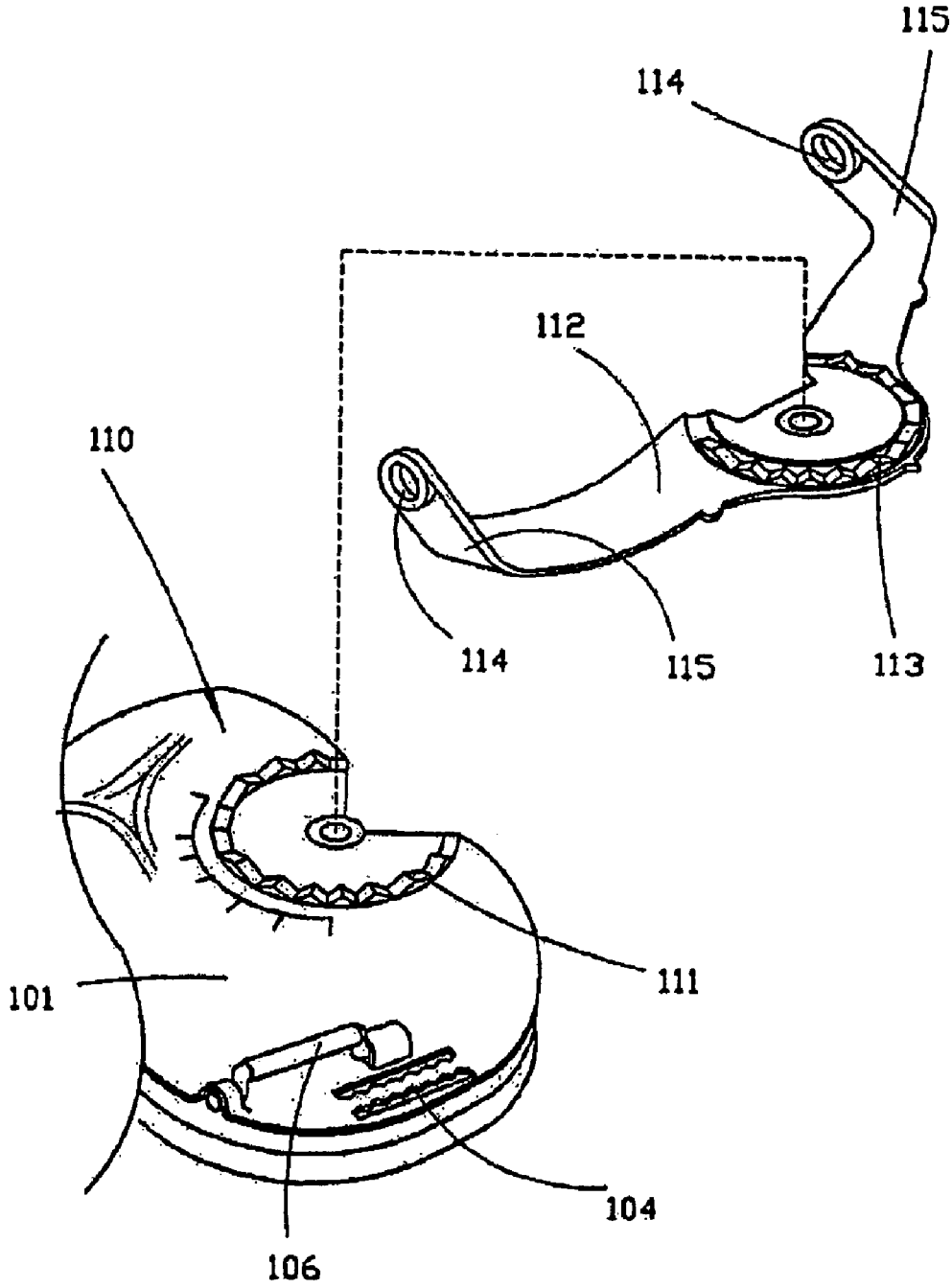
FIG. 5 is an exploded, perspective view of a hand pad assembly according to the present invention, on which saw-toothed protrusions are formed.
Figure 6:
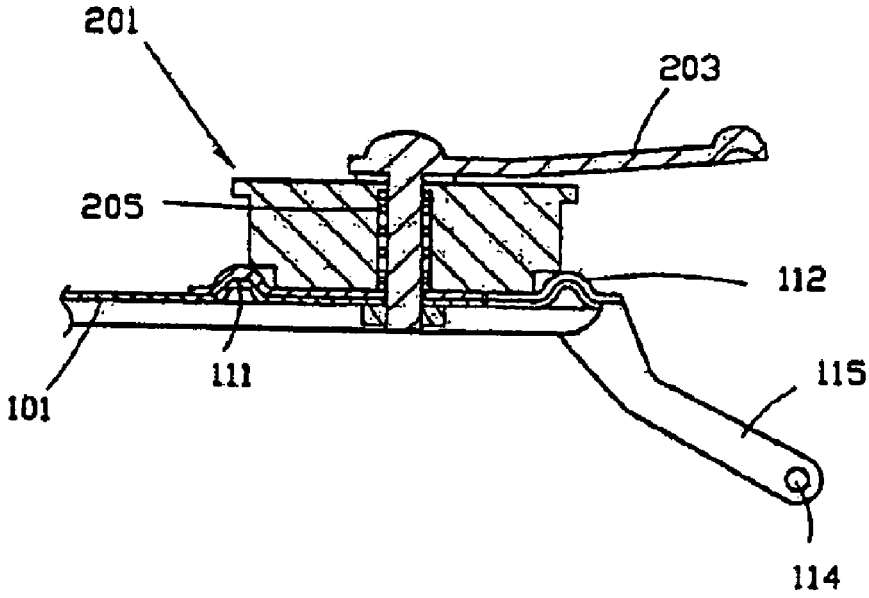
FIG. 6 is a sectional view showing a combination of a horizontal angle adjusting means and a vertical angle adjusting means according to the present invention.
Figure 7:
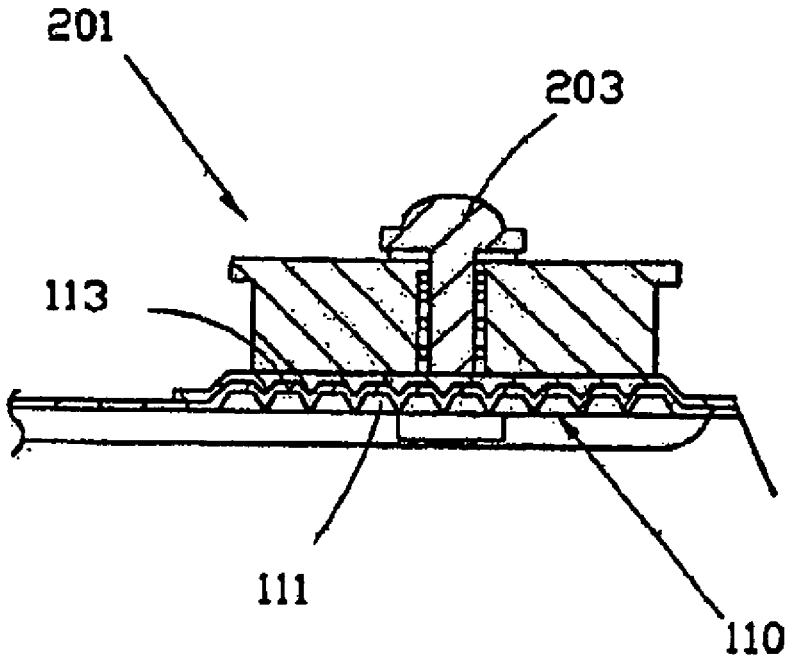
FIG. 7 is a sectional view of one embodiment of a horizontal angle adjusting means according to the present invention.
Figure 8:
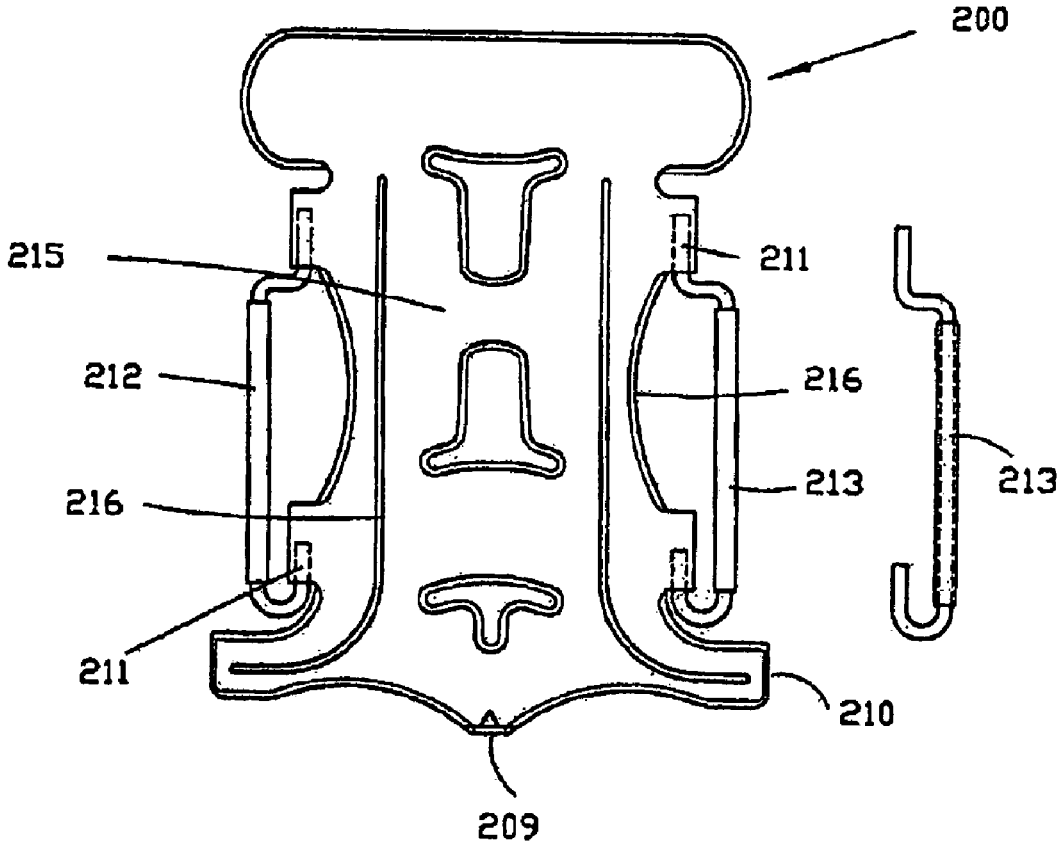
FIG. 8 is a plain view of a wrist pad according to the present invention.

A hand-strap slot 103 for fastening a hand-strap 102 thereto is formed adjacent to one end of the hand pad 101. The hand-strap slot 103 is provided with jagged protrusions 104 so as to precisely adjust the hand-strap 102 in desired position and prevent the hand-strip 102 from slipping off while the hand-strap is pulled. Moreover, a fixed roller 105 is installed to the opposite side of the hand-strap slot 103, which not only facilitates an attraction of the hand-strap 102 that ties a hand to the hand pad 101, but also prevent damage of the hand-strap 102 caused by friction. As shown in FIG. 4, the hand-strap 102 rolled around a movable roller 106 is finally fastened by means of a Velcro tape 107.

Due to the partial rotation of the movable roller 106, separation between the back of a bowler's hand and the hand pad 101 rarely happens even though a bowler perpendicularly pulls the hand-strap 102 in order to further tighten the hand-strap 102. Furthermore, the bias of the hand pad 101, which frequently occurs when the hand-strap 102 is perpendicularly pulled with respected to the hand pad 101, can be effectively inhibited by the function of the movable roller 106.

A horizontal angle adjusting means 110 for controlling a horizontal angle of the hand pad 101 and a vertical angel adjusting means 201 for controlling a vertical angle of the wrist pad 200 are interactively mounted together at the center of one end of the hand pad 101.

Figure 1:
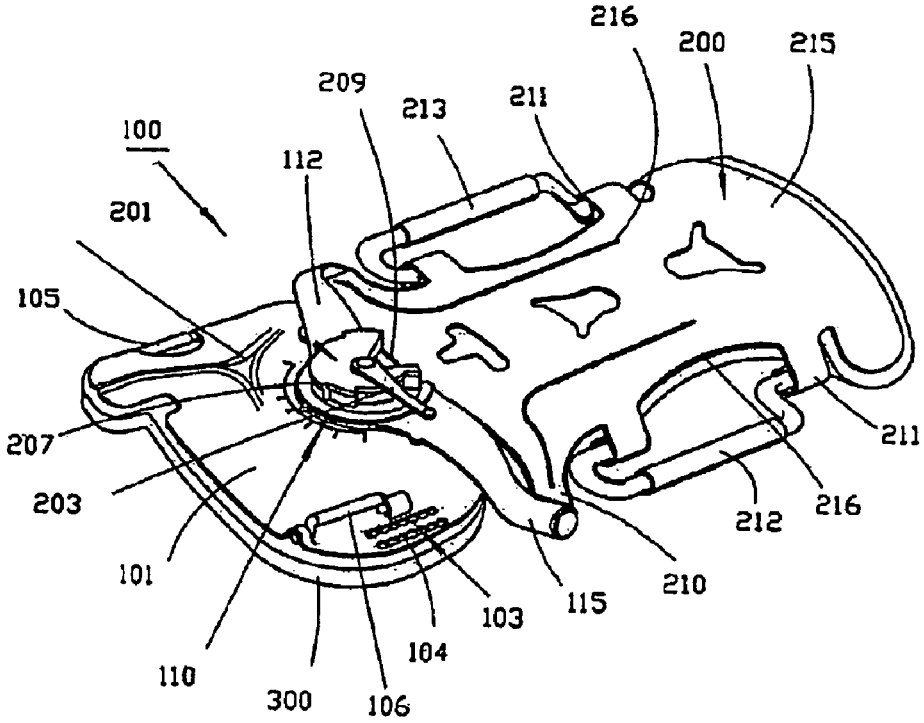
FIG. 1 is a perspective view of the a wrist supporting apparatus according to the present invention.
Figure 2:
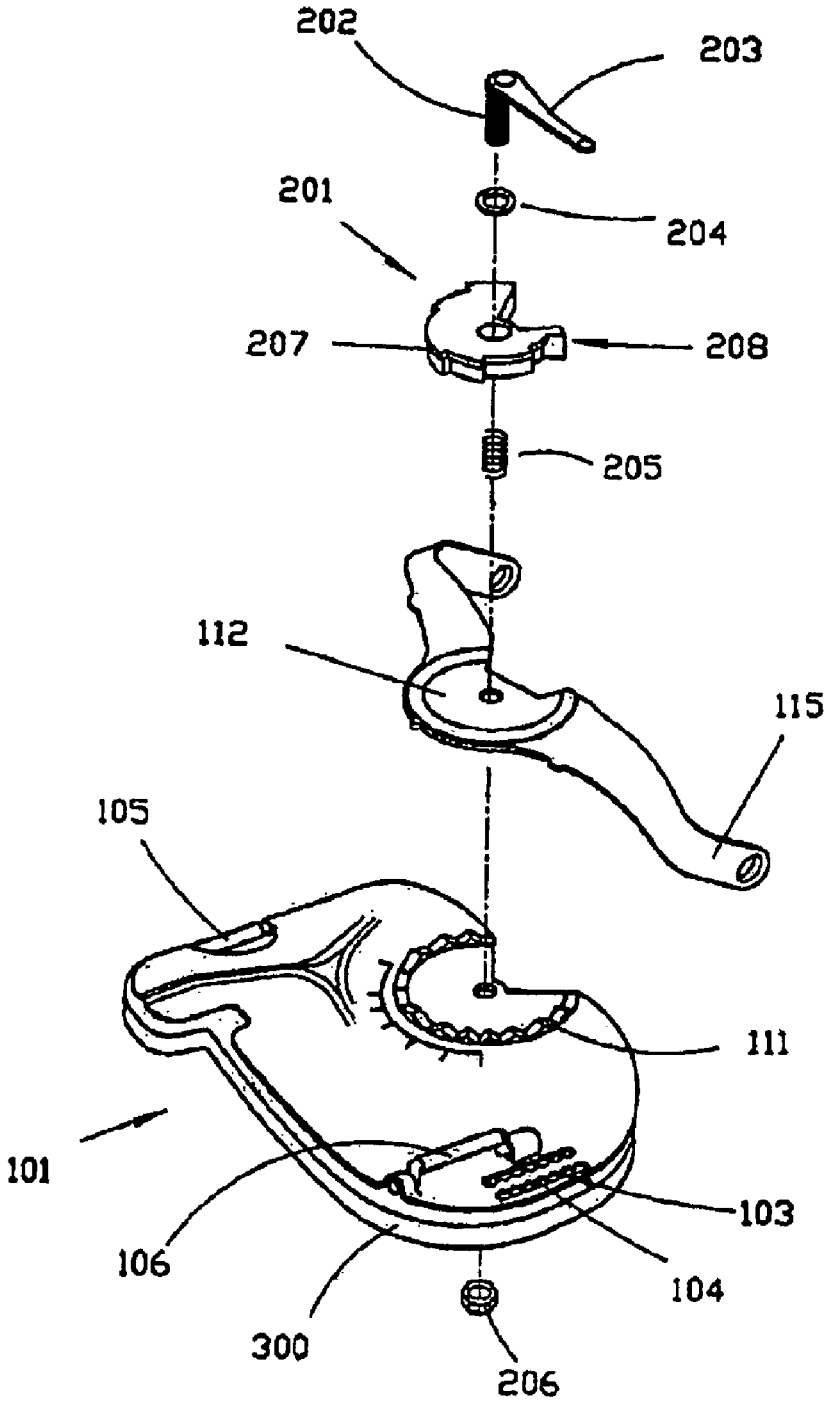
FIG. 2 is an exploded, perspective view of a hand pad assembly according to the present invention.
Figure 3:
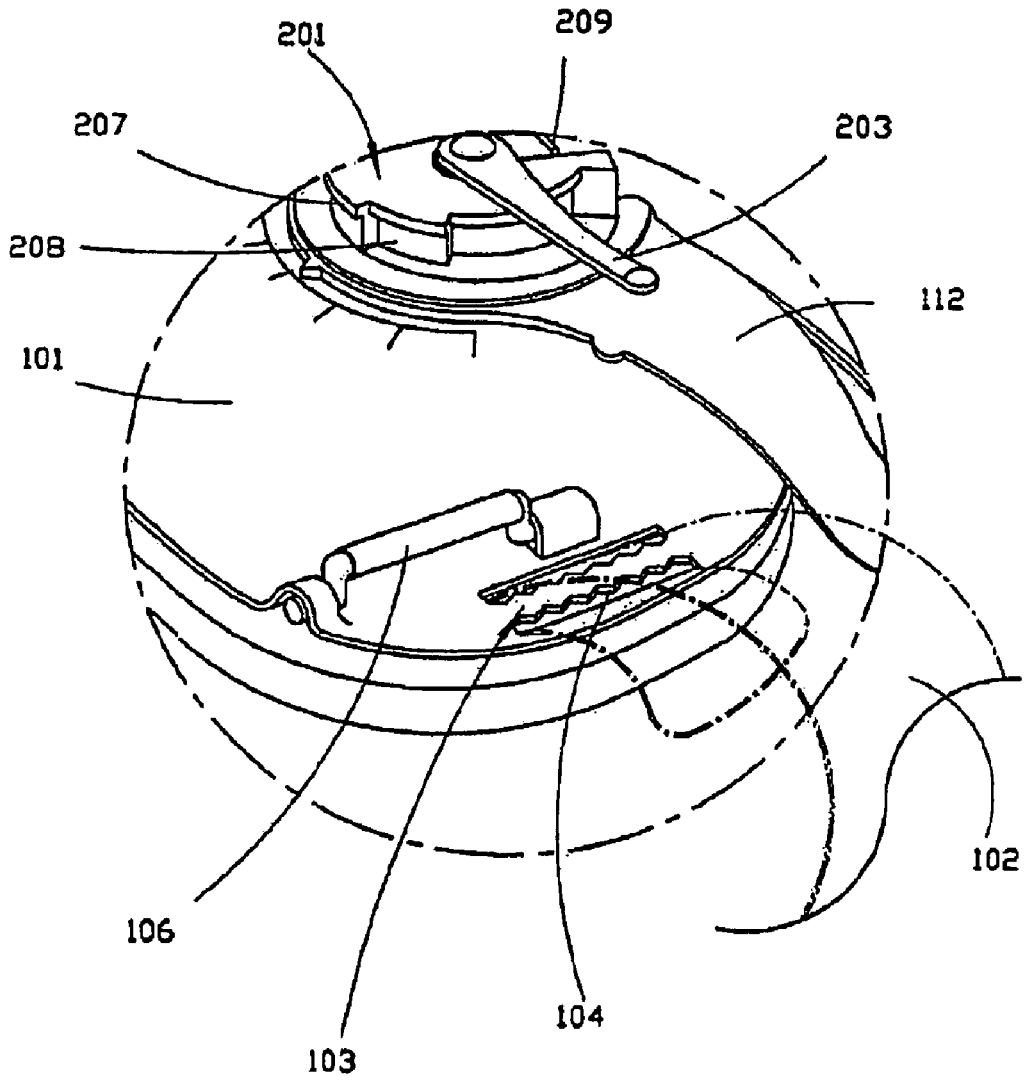
FIG. 3 is an enlarged, perspective view of a hand pad assembly of the present invention with installation of a hand-strap.

As shown in FIG. 2, formed on the center of one end of the hand pad 101 are saw-toothed protrusions 111. A center plate 112 to construct the vertical angel adjusting means 110 by engaging to the saw-toothed protrusions 111 of the hand pad 101 comprises a plurality of saw-toothed protrusions 113 same as said saw-toothed protrusions 111 on the bottom surface thereof, a supporting bridge 115 outwardly extending therefrom, and a connecting hole 114 formed at one end of said supporting bridge 115. As known from the description above, the saw-toothed protrusions 111 formed on the hand pad 101 and the saw-toothed protrusions 113 formed on the bottom surface of the center plate 112 interlock each other so that it is possible to precisely adjust a vertical angle of the hand pad 101 and to firmly secure the vertical angel of the hand pad 101 during a bowling.

A vertical angle adjusting means 201 comprising a handle 203 attached to a threaded shaft 202, a washer 204, a spring 205, and an angle adjusting disk 208 having a contour of stair shape, is located above the hand pad 101 and the center plate 112. The vertical angle adjusting means 201 is fixed with the hand pad 101 and the center plate 112 by screwing a nut 206 to the threaded shaft 202 of the handle 203.

The vertical angel adjusting means 201 changes an angle of the hand pad 101 over the wrist pad 200 by rotating the angel adjusting disk 208 having a contour of stair shape, wherein the angle adjusting disk is held by a supporting tip 209 disposed at one end of the wrist pad 200. The angle adjusting disk 208 is provided with a flange 207 at circumference thereof, which covers the supporting tip 209, whereby the interference with external objects such as sleeve of a bowler is effectively inhibited.

The supporting bridge 115 extending from the center plate 112 is pivotally connected to a connecting part 210 of the wrist pad 115 by a fastening means such as a rivet or a bolt.

The wrist pad 200 having a symmetric shape is provided with inserting holes 211 at the both sides thereof for accommodating movable rollers 212, 213 for a wrist-strap. Because the wrist pad 200 equipped with identical shape of movable rollers 212, 213 at the both side thereof is symmetrical, the cost involved in manufacturing the wrist pad 200 depending on its direction is significantly reduced.

Figure 9:
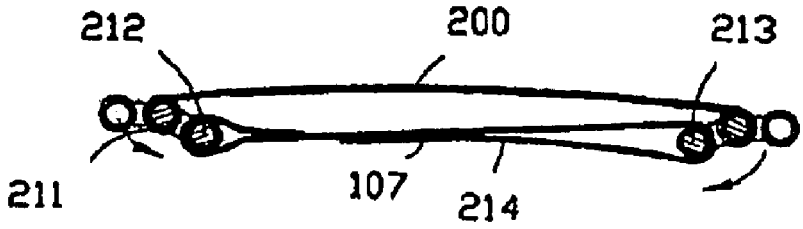
FIG. 9 is a sectional view showing a state of a wrist-strap fastened by rollers of a wrist pad according to the present invention in case of the right-handed bowler.

In case that left-handed bowler wears the wrist supporting apparatus of the present invention, as shown in FIG. 9, the one end of the wrist-strap 214 is permanently fixed to the left movable roller 212 while the other end of the wrist-strap 214 rounds the right moveable roller 213 and is fastened by a Velcro tape 107.

Figure 10:
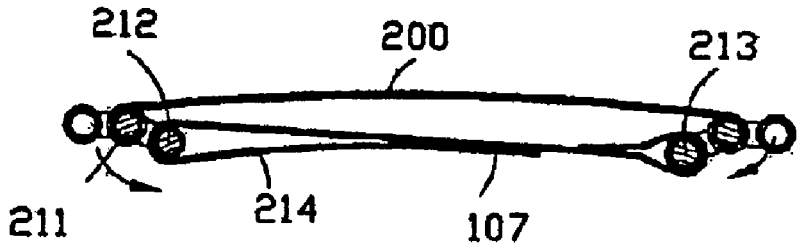
FIG. 10 is a sectional view showing a state of a wrist-strap fastened by rollers of a wrist pad according to the present invention in case of the left-handed bowler.

In case that right-handed bowler wears the wrist supporting apparatus of the present invention, as shown in FIG. 10, the one end of the wrist-strap 214 is permanently fixed to the right movable roller 212 while the other end of the wrist-strap 214 rounds the left moveable roller 213 and is fastened by a Velcro tape 107.

Furthermore, it is desirable to implant a supplemental element 216 to the upper surface 215 of the wrist pad 200 so as to reinforce stiffness of the wrist pad 200. In the meantime, attached to the bottom surface of the wrist pad 200 is resilient material 300 for improving comfort.

Figure 11:
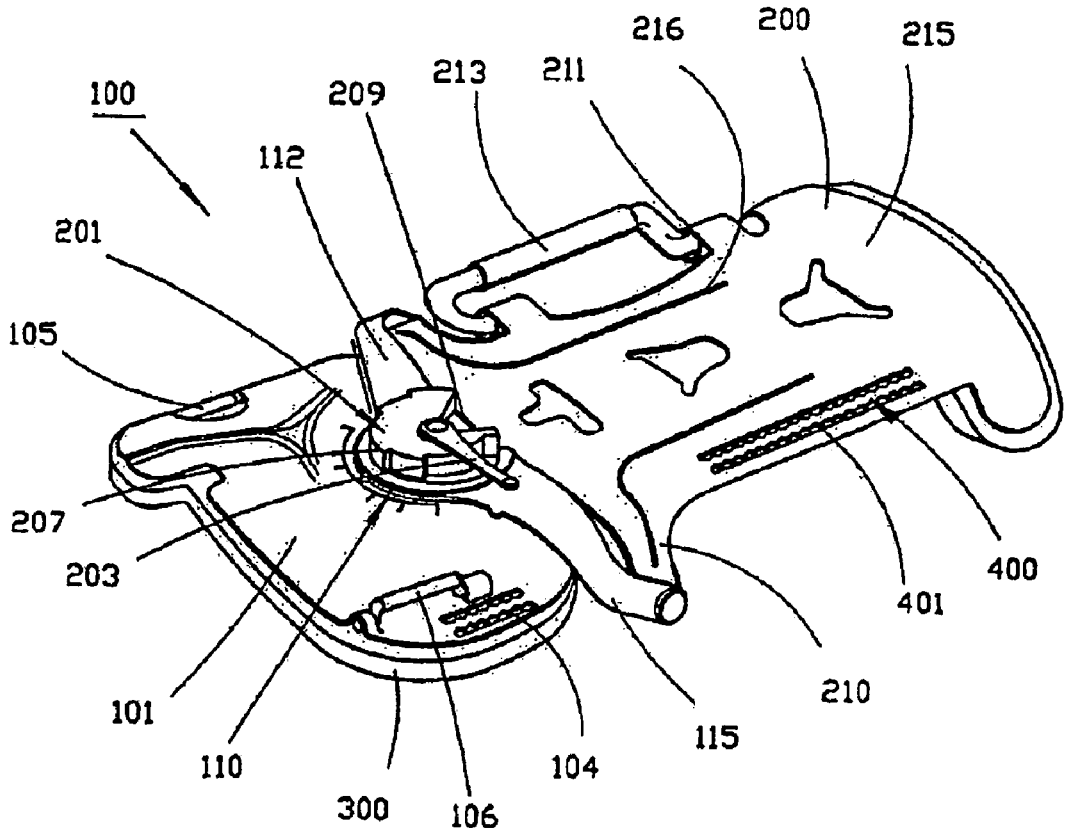
FIG. 11 is an alternative embodiment of the present invention.

The accompanying FIG. 11, which shows an alternative embodiment of the present invention, discloses a wrist supporting apparatus comprising a wrist pad 200 on which a wrist-strap slot 400 is formed, wherein the wrist-strap slot 400 is provided with a plurality of jagged protrusions 401 so as to readily adjust and firmly secure the wrist-strap 214 in desired position.

As described above, the wrist supporting apparatus according to the present invention comprising a hand-strap slot, fixed roller, a movable roller, a horizontal angle adjusting means, a vertical angel adjusting means, and a wrist pad of symmetrical shape, is advantageous in that not only the a horizontal angle and/or a vertical angle between the hand pad and the wrist pad can be readily adjusted with easy, but also remarkable improvement in productivity can be expected by employing the wrist pad of symmetrical shape.

Even though the present invention is described in detail with reference to one embodiment, it is not intended to limit the scope of the present invention. It is evident from the foregoing that many variations and modifications may be made by a person having an ordinary skill in the present filed without departing from the essential concept of the present invention.

What is claimed is:

1. A wrist supporting apparatus for bowing having an angle adjusting means, the wrist supporting apparatus comprising:

a hand-strap slot for accommodating one end of a hand-strap that securely fixes a hand pad to the back of the hand of a bowler, the hand-strap slot being formed adjacent to the one end of the hand pad and provided with jagged protrusions so as to adjust and secure the hand-strap in desired position;

a fixed roller facilitating an attraction of the hand-strap fastened to said hand-strap slot by reducing a friction when fastening the hand-strap;

a moveable roller for hand-strap that further firmly attracts the hand-strap being tensed by the fixed roller, whereby the hand-strap can be fasten with optimized tension by means of a Velcro tape;

a horizontal angel adjusting means including saw-toothed protrusions formed on an upper surface of a hand pad and a bottom surface of a center plate so as to precisely adjust and firmly secure the hand pad in a preferred angle with respect to a wrist pad;

a vertical angle adjusting means for adjusting vertical angle of a hand pad with respect to a wrist pad, on which a flange is formed at circumference thereof so as to prevent slipping out of a supporting tip disposed at one end of a wrist pad;

two movable rollers for a wrist strap that are disposed at the both side of a wrist pad; and a wrist pad that is pivotally connected to a hand pad by means of rivet or a bolt.

2. A wrist supporting apparatus according to claim 1, wherein the wrist pad has a symmetrical shape so that the wrist pad can be installed to any hand pads regardless of its direction.

3. A wrist supporting apparatus according to claim 1, wherein a plurality of embossed protrusions are located in the vicinity of the hand-strap slot.

4. A wrist supporting apparatus according to claim 1, wherein the wrist pad is provided with a wrist-strap slot on which a plurality of jagged protrusions are formed so as to firmly secure the wrist-strap.

* * * * *